US009052678B2

(12) United States Patent
Oka et al.

(10) Patent No.: US 9,052,678 B2
(45) Date of Patent: Jun. 9, 2015

(54) CLEANING DEVICE, PROCESS CARTRIDGE AND IMAGE FORMING APPARATUS

(75) Inventors: Hideto Oka, Tokyo (JP); Masao Uyama, Mishima (JP); Kenji Shindo, Yokohama (JP); Nobuyoshi Yoshida, Suntou-gun (JP); Ryosuke Kanai, Kawasaki (JP); Satoru Inami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/234,278

(22) PCT Filed: Aug. 29, 2012

(86) PCT No.: PCT/JP2012/072529
§ 371 (c)(1),
(2), (4) Date: Jan. 22, 2014

(87) PCT Pub. No.: WO2013/032024
PCT Pub. Date: Mar. 7, 2013

(65) Prior Publication Data

US 2014/0153990 A1 Jun. 5, 2014

(30) Foreign Application Priority Data

Aug. 30, 2011 (JP) ..... 2011-187329

(51) Int. Cl.
*G03G 21/00* (2006.01)

(52) U.S. Cl.
CPC ..... *G03G 21/0011* (2013.01); *G03G 21/0029* (2013.01)

(58) Field of Classification Search
CPC ..... G03G 21/0029
USPC ..... 399/102, 350, 351, 123
See application file for complete search history.

(56) References Cited

U.S. PATENT DOCUMENTS 4,396,276 A 8/1983 Murasaki
4,739,370 A 4/1988 Yoshida et al.

(Continued)

FOREIGN PATENT DOCUMENTS

JP 56-159678 12/1981
JP 59-182483 10/1984

(Continued)

OTHER PUBLICATIONS

Office Action dated Jun. 24, 2013, in Japanese Patent Application No. 2011-187329.

(Continued)

*Primary Examiner* — Rodney Bonnette
(74) *Attorney, Agent, or Firm* — Fitzpatrick, Cella, Harper & Scinto

(57) ABSTRACT

A cleaning device includes a fixing portion provided on a frame, a cleaning member, and an accommodating portion. The cleaning member includes a blade portion contacted to an image bearing member (drum) and a supporting member. The supporting member includes one end portion where the blade portion is provided, another end portion including a portion-to-be-fixed for being fixed at the fixing portion, and a bent portion between the one end portion and the other end portion in a side remote from a surface of the drum toward an outside with respect to a line connecting the portion-to-be-fixed and a contact portion where the blade portion is contacted to the drum. The portion-to-be-fixed is provided downstream of the contact portion with respect to movement direction of the drum. Between the frame and the other end portion, a gap for permitting elastic deformation of the other end portion is provided.

13 Claims, 12 Drawing Sheets

(56) References Cited

U.S. PATENT DOCUMENTS

| | | | | |
|---|---|---|---|---|
| 4,812,878 | A | 3/1989 | Kaieda | |
| 5,995,785 | A | 11/1999 | Kato et al. | |
| 6,137,973 | A * | 10/2000 | Nishiuwatoko et al. | 399/111 |
| 6,459,866 | B1 * | 10/2002 | Meguro | 399/102 |
| 2007/0019989 | A1 * | 1/2007 | Nakamori | 399/159 |
| 2010/0300484 | A1 | 12/2010 | Gumbe et al. | |
| 2013/0071164 | A1 * | 3/2013 | Sunahara | 399/350 |
| 2013/0216287 | A1 * | 8/2013 | Inami | 399/351 |
| 2014/0037323 | A1 * | 2/2014 | Oka | 399/102 |
| 2014/0153989 | A1 * | 6/2014 | Shindo et al. | 399/351 |

FOREIGN PATENT DOCUMENTS

| | | | |
|---|---|---|---|
| JP | 59-208569 | A | 11/1984 |
| JP | 63-129386 | A | 6/1988 |
| JP | 6-95502 | A | 4/1994 |
| JP | 7-306621 | A | 11/1995 |
| JP | 2002-341721 | A | 11/2002 |

OTHER PUBLICATIONS

U.S. Appl. No. 14/131,060, filed Jan. 6, 2014.
U.S. Appl. No. 13/727,828, filed Dec. 27, 2012.

* cited by examiner (a)

(b)

(a)

(b)

(a)

(b)

CLEANING DEVICE, PROCESS CARTRIDGE AND IMAGE FORMING APPARATUS

TECHNICAL FIELD

The present invention relates to a cleaning device for removing a developer from a surface of an image bearing member, a process cartridge and an image forming apparatus.

Here, as the image forming apparatus, e.g., an electrophotographic copying machine, a laser beam printer, an LED printer, a facsimile machine and the like are included. Further, the process cartridge refers to a cartridge prepared by integrally assembling at least image bearing member and the cleaning device so as to be detachably mountable to the image forming apparatus.

BACKGROUND ART

In the electrophotographic image forming apparatus, a cleaning blade type as a cleaning means for removing, in order to repetitively use the image bearing member, the developer remaining on the image bearing member after transferring a developer image from the image bearing member onto a recording material (medium) has been known.

The cleaning blade cleaning type is a method in which a blade having elasticity is contacted to the surface of the image bearing member at a predetermined pressure to remove the developer from the surface of the image bearing member.

In Japanese Laid-Open Patent Application (JP-A) 2002-341721, the cleaning member has a structure in which a blade is mounted by molding at an end of a metal plate as a supporting member. Further, the metal plate is secured to a frame by a screw or the like to fix the cleaning member, so that the cleaning member is contacted to the surface of the image bearing member at the predetermined pressure.

However, the image forming apparatus such as the printer tends to be downsized, increased in speed and improved in image quality with popularization thereof. When the image forming apparatus is downsized, a size of the image bearing member becomes small. Further, by the speed-up, the image bearing member is quickly rotated. That is, the blade contacted to the image bearing member surface repetitively slides on the image bearing member surface at high speed. Then, a temperature of the blade itself is increased, so that hardness of the blade is decreased. As a result, a frictional force between the image bearing member surface and the blade is increased. Thus, there can arise a problem of an increase in driving torque for driving the image bearing member and turning-up of the blade. Further, in recent years, a spherical developer is used in order to improve the image quality. In this case, in order to remove the developer from the image bearing member surface, there is a need to increase a contact pressure of the blade to the image bearing member, thus constituting one of factors which accelerate the above-described problem.

SUMMARY OF THE INVENTION

The present invention has been accomplished in order to solve the above-described problem of the prior art. A principal object of the present invention is to provide a cleaning member, a cleaning device, a process cartridge and an image forming apparatus which are capable of suppressing an increase in driving torque and turning-up of a blade when an image bearing member is driven.

According to an aspect of the present invention, there is provided a cleaning device for use with an image forming apparatus, comprising: a fixing portion provided on a frame;

a cleaning member, to be fixed at the fixing portion, for removing a developer from an image bearing member, wherein the cleaning member includes: a blade portion contacted to the image bearing member with respect to a counter direction to a movement direction of the image bearing member; and a flexible supporting member for supporting the blade portion, the supporting member including one end portion where the blade portion is provided, another end portion including a portion to be fixed for being fixed at the fixing portion, and a bent portion between the one end portion and the another end portion in a side remote from a surface of the image bearing member toward an outside with respect to a line connecting the portion to be fixed and a contact portion where the blade portion is contacted to the image bearing member, wherein the portion to be fixed is provided downstream of the contact portion with respect to movement direction of the image bearing member; and an accommodating portion, defined by the frame, for accommodating the developer removed from the image bearing member, wherein between the frame and the another end portion, a gap for permitting elastic deformation of the another end portion is provided.

According to another aspect of the present invention, there is provided a cleaning device for use with an image forming apparatus, comprising: a fixing portion provided on a frame; a cleaning member, to be fixed at the fixing portion, for removing a developer from an image bearing member, wherein the cleaning member includes: a blade portion contacted to the image bearing member with respect to a counter direction to a movement direction of the image bearing member; and a flexible curve-shaped supporting member for supporting the blade portion, the supporting member including a blade portion supporting portion where the blade portion is provided in its end side, a portion to be fixed for being fixed at the fixing portion, and a bent top between the one end portion and the another end portion in a side remote from a surface of the image bearing member toward an outside with respect to a line connecting the portion to be fixed and a contact portion where the blade portion is contacted to the image bearing member, wherein the portion to be fixed is provided downstream of the contact portion with respect to movement direction of the image bearing member; and an accommodating portion, defined by the frame, for accommodating the developer removed from the image bearing member, wherein between the frame and a region ranging from the bent top to the portion to be fixed, a gap for permitting elastic deformation of the region is provided.

These and other objects, features and advantages of the present invention will become more apparent upon a consideration of the following description of the preferred embodiments of the present invention taken in conjunction with the accompanying drawings.

Figure 7:
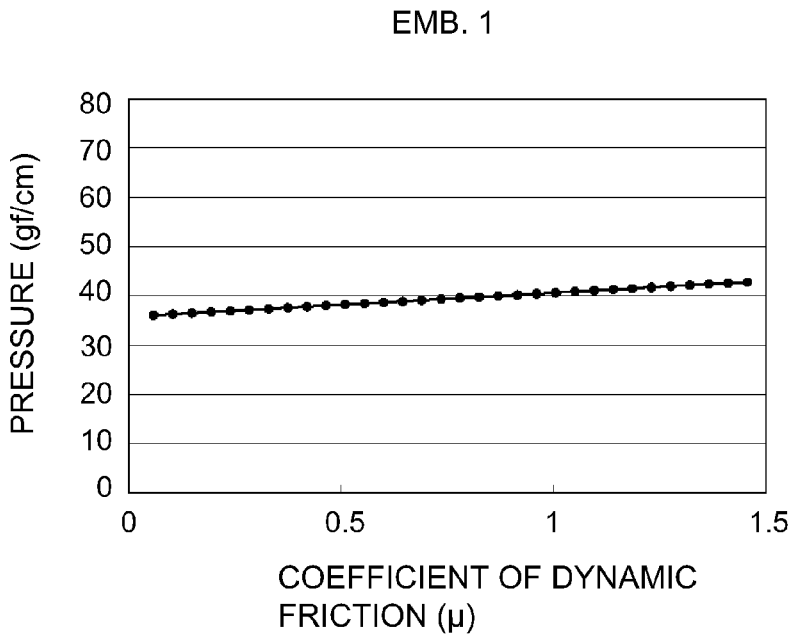
Figure 7:
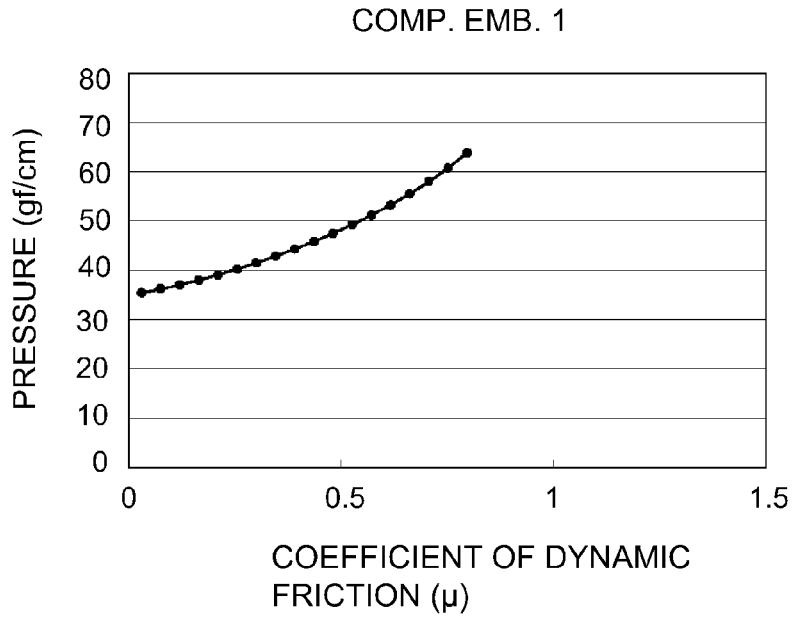

Parts (a) and (b) of FIG. 7 are graphs each showing a result of simulation calculation of a relationship between a coefficient of dynamic friction and a cleaning device.

Figure 8:
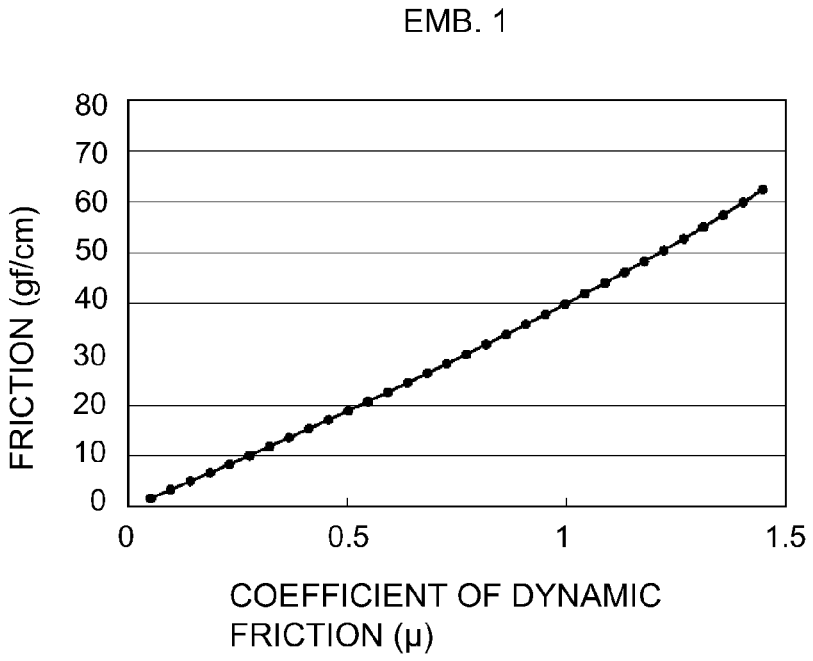
Figure 8:
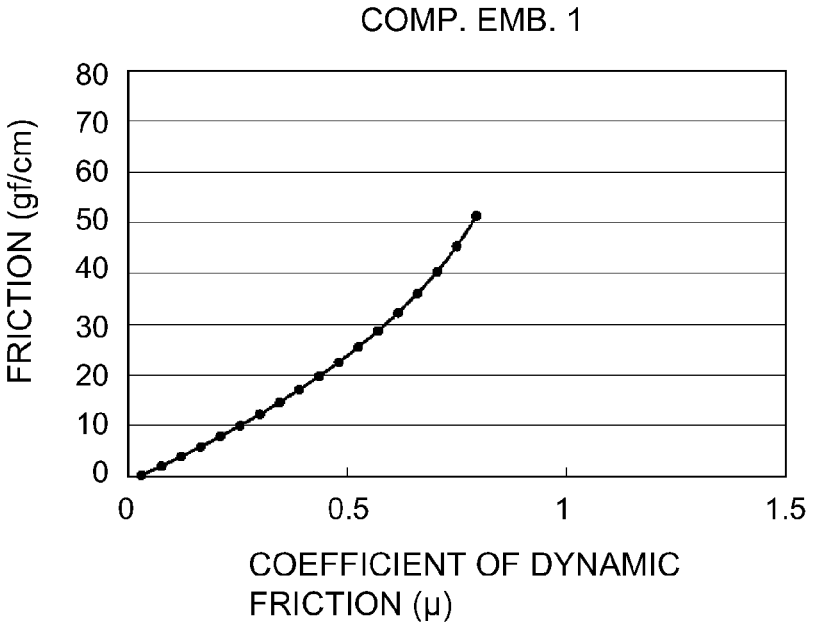

Parts (a) and (b) of FIG. 8 are graphs each showing a result of simulation calculation of a relationship between a coefficient of dynamic friction and a frictional force.

Figure 9:
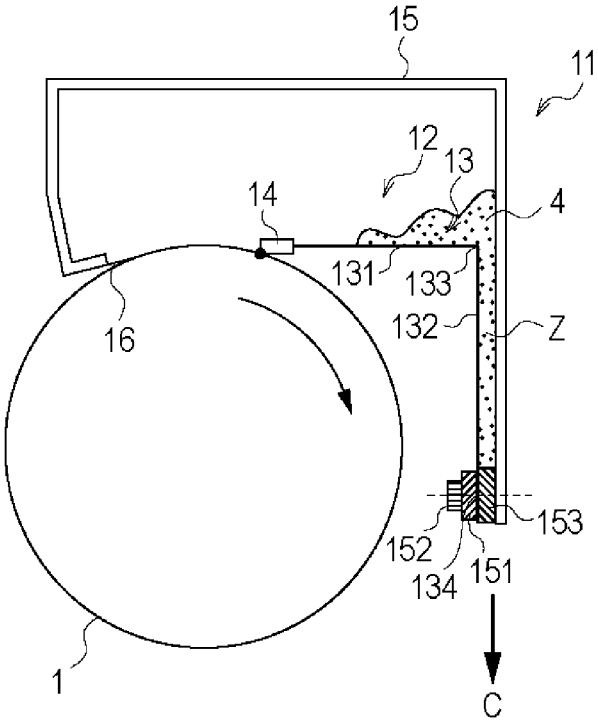

FIG. 9 is a schematic illustration of a cleaning device in which a toner is localized.

Figure 10:
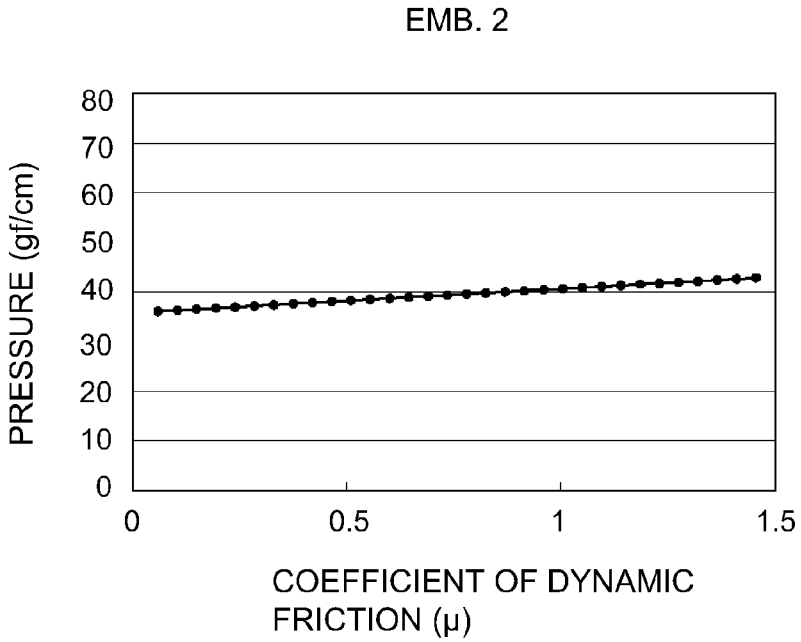
Figure 10:
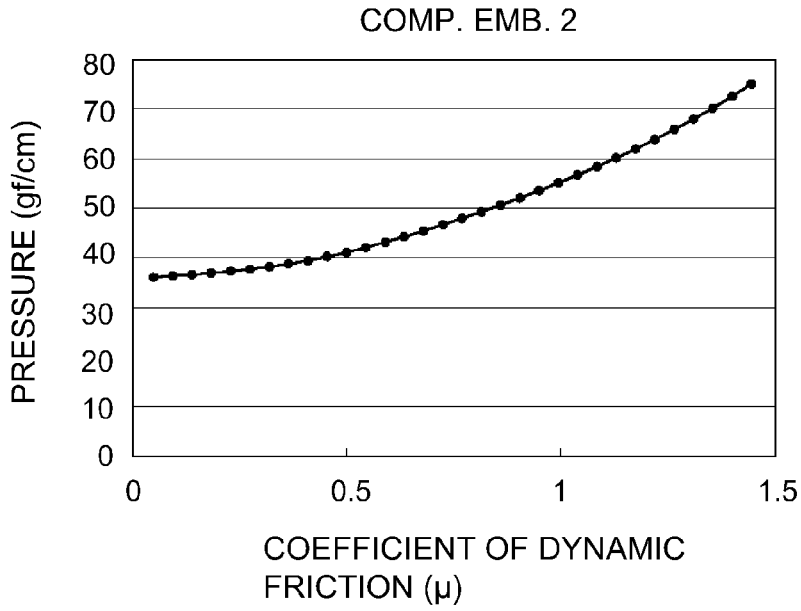

Parts (a) and (b) of FIG. 10 are graphs each showing a result of simulation calculation of a relationship between a coefficient of dynamic friction and a cleaning device.

Figure 11:
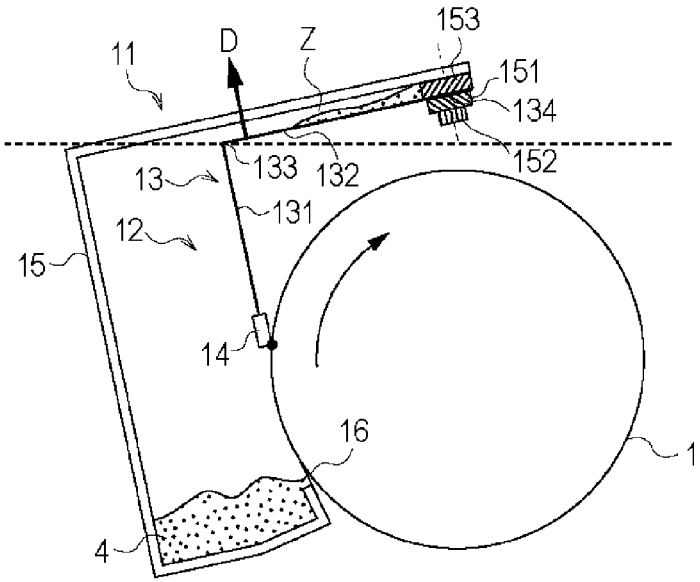

FIG. 11 is a schematic illustration of a cleaning device in Embodiment 2.

Figure 12:
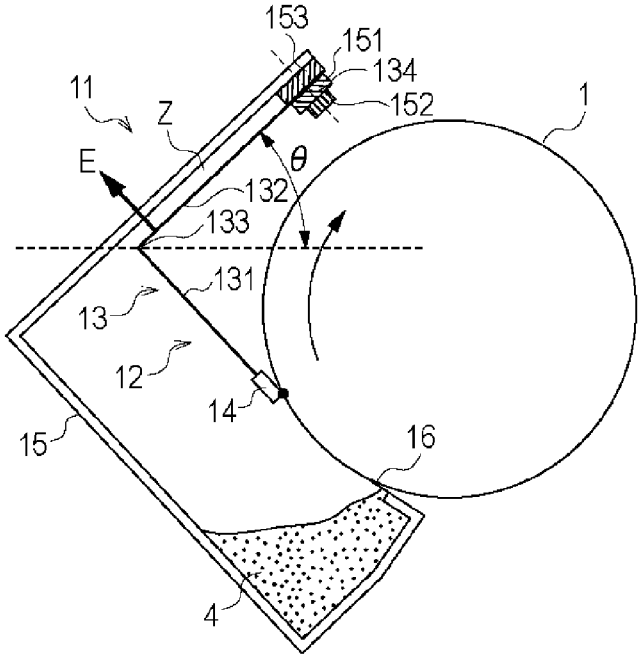

FIG. 12 is a schematic illustration of a cleaning device in Embodiment 3.

Figure 13:
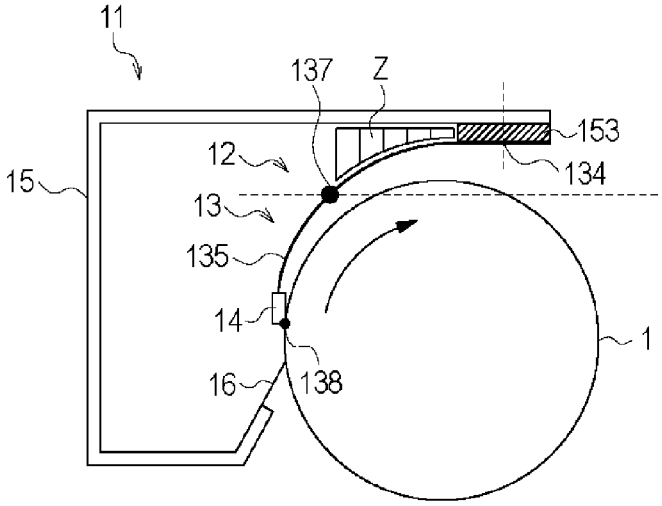

FIG. 13 is a schematic illustration of a cleaning device in Embodiment 4.

Figure 14:
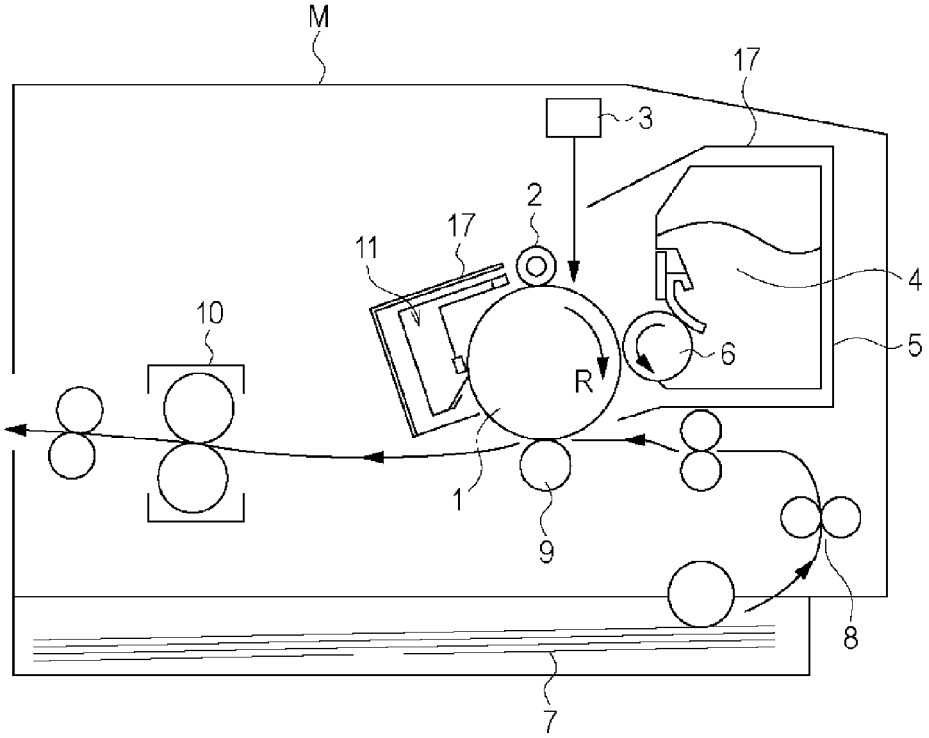

FIG. 14 is a schematic illustration of an example of an image forming apparatus in Embodiment 1.

Figure 15:
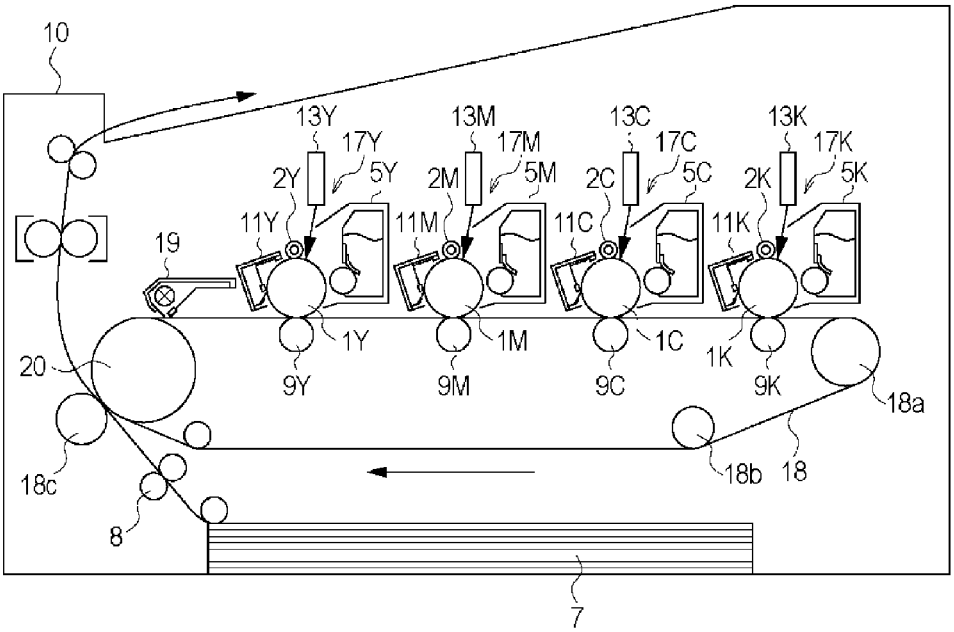

FIG. 15 is a schematic illustration of an example of a color image forming apparatus of a tandem type in Embodiment 1.

Figure 16:
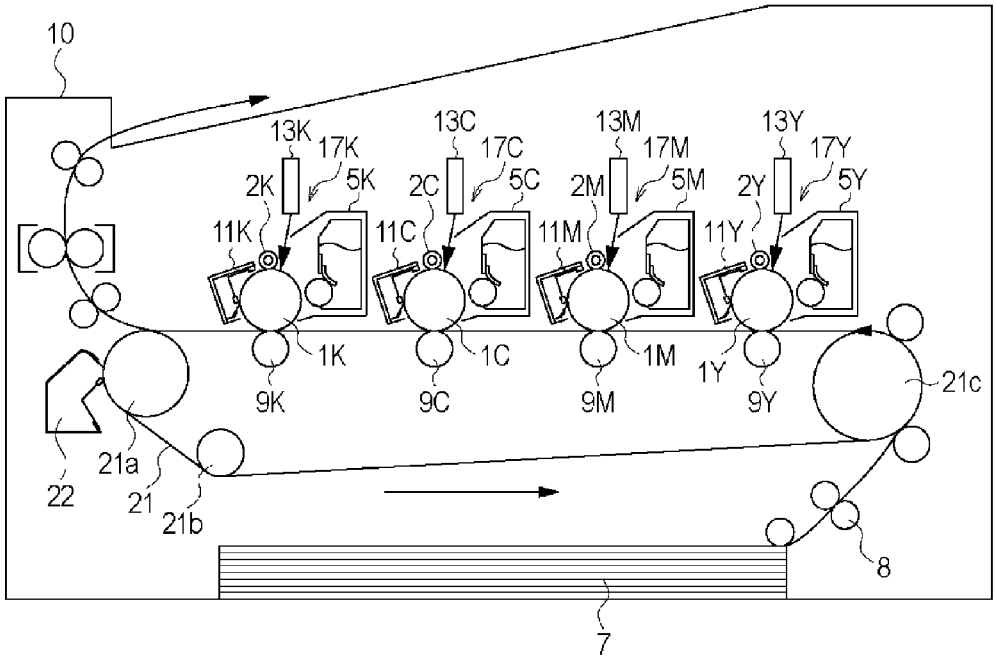

FIG. 16 is a schematic illustration of an example of an image forming apparatus including a recording material conveying member in Embodiment 1.

Figure 17:
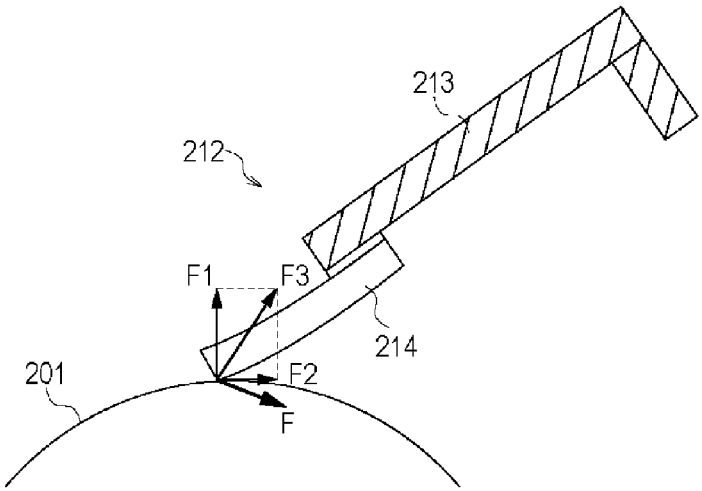

FIG. 17 is a schematic illustration of a cleaning member in Comparative Embodiment.

Figure 18:
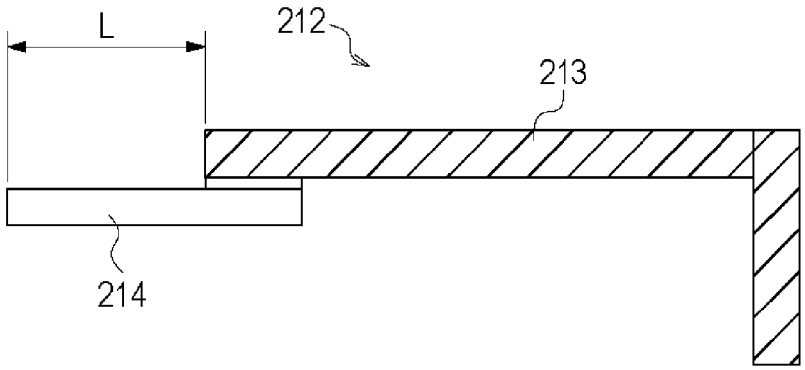

FIG. 18 is a detailed structural view of the cleaning member in Comparative Embodiment.

Figure 19:
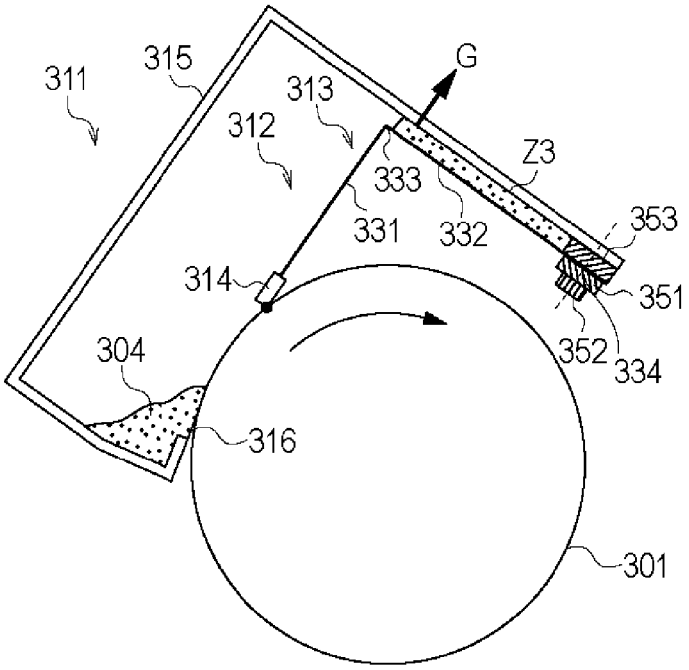

FIG. 19 is a schematic illustration of a cleaning device in Comparative Embodiment 2.

EMBODIMENTS FOR CARRYING OUT THE INVENTION

Embodiment 1

An example of an image forming apparatus according to this embodiment will be described. The image forming apparatus shown in FIG. 14 is a monochromatic laser beam printer of an electrophotographic type, and FIG. 14 is a schematic illustration of the image forming apparatus.

In the neighborhood of a substantially central portion of a main assembly M of the image forming apparatus, a drum-type photosensitive drum 1 as an image bearing member (member to be charged) is provided. The photosensitive drum 1 is prepared by forming an OPC (organic photoconductor (optical semiconductor)) photosensitive layer on an outer peripheral surface of an electroconductive drum support of aluminum or the like. The photosensitive drum 1 is rotationally driven in an arrow R direction at a predetermined process speed of 200 mm/sec.

The surface (peripheral surface) of the photosensitive drum 1 is electrically charged uniformly to a predetermined polarity and a predetermined potential by a charging roller 2 as a charging means. The surface of the photosensitive drum 1 after the charging is subjected to scanning exposure to a laser beam, outputted from a laser beam scanner 3 as an exposure means, modulated correspondingly to a time-series electric digital pixel signal of objective image information. Then, an electrostatic latent image corresponding to the objective image information is formed. On this electrostatic latent image, a toner (developer) 4 conveyed by a developing sleeve 6 of a developing device 5 is deposited, so that the latent image is developed as a toner image.

A recording material 7 is fed by a sheet feeding roller 8 and is sent to a transfer nip between the photosensitive drum 1 and a transfer roller 9 so as to be synchronized with the toner image formed on the photosensitive drum 1, so that the toner image is transferred onto the surface of the recording material 7. To the transfer roller 9, a transfer bias for transfer is applied from a transfer bias applying power (voltage) source (not shown) during the transfer. The recording material 7 subjected to the toner image transfer is separated from the surface of the photosensitive drum 1 and then is conveyed to a fixing device 10, where the toner image is heated and pressed to be fixed on the surface of the recording material 7.

On the other hand, the photosensitive drum 1 after the toner image transfer is subjected to removal of a residual toner, remaining on the surface thereof without being transferred onto the recording material 7, by a cleaning device 11 as a cleaning means, and then is subjected to subsequent image formation.

Further, this embodiment is also applicable to cleaning of a color image forming apparatus. FIG. 15 shows an example of a color image forming apparatus of a tandem type. The color image forming apparatus is a color laser printer using a transfer type, an electrophotographic process, a contact charging type, a reverse development type, and A3 size as a maximum sheet passing size. The color image forming apparatus is a 4-drum type (in-line) printer in which a plurality of process cartridges 17 are provided and color toner images are once successively transferred superposedly onto an intermediary transfer belt 18 which is a second image bearing member (image carrying member) to obtain a full-color print image.

In FIG. 15, the endless intermediary transfer belt 18 is stretched by a driving roller 18*a*, a tension roller 18*b* and a secondary transfer opposite roller 18*c* and is rotationally driven in an arrow direction indicated in the figure at a predetermined process speed of 300 mm/sec. Four process cartridges 17 are disposed in line with the intermediary transfer belt 18 in the order of those for yellow 17Y, magenta 17M, cyan 17C and black 17K.

In the color image forming apparatus of the tandem type, four cleaning devices (image bearing members) (11Y, 11M, 11C, 11K) are provided and therefore a driving torque generated during drive of photosensitive drums (1Y, 1M, 1C, 1K) is large. However, when the constitution of this embodiment is applied, a reducing effect of the driving torque becomes large.

Further, as shown in FIG. 15, this embodiment is also applicable to an intermediary transfer cleaner 19 for removing the toner 4 remaining on the intermediary transfer belt 18 behind a secondary transfer 20. In this embodiment, a constitution in which the toner 4 collected by the intermediary transfer belt cleaner 19 is conveyed to a residual toner collecting container (not shown) by a screw is employed.

Further, this embodiment is also applicable as a cleaning device for a transfer and conveyance belt 21 for conveying the recording material P and for transferring the toner image from the photosensitive drum 1. FIG. 16 shows an example of a color image forming apparatus of a tandem type including the transfer and conveyance belt 21. In FIG. 16, the endless transfer and conveyance belt 21 is stretched by a driving roller 21*a*, a tension roller 21*b* and a follower roller 21*c* and is rotationally driven in an arrow direction indicated in the figure at a predetermined process speed of 300 mm/sec. Four process cartridges 17 are disposed in line with the transfer and conveyance belt 21 in the order of those for yellow 17Y, magenta 17M, cyan 17C and black 17K. The recording material 7 is conveyed by the transfer and conveyance belt 21 and onto which toner images formed on photosensitive drums (1Y, 1M, 1C, 1K) are successively transferred by transfer rollers (9Y, 9M, 9C, 9K). On the photosensitive drums (1Y, 1M, 1C, 1K), a fog toner is present, and the surface of the transfer and conveyance belt 21 is contaminated with the fog toner during an interval of adjacent recording materials 7. This fog toner is collected by a transfer and conveyance belt cleaner 22.

The cleaning member 12 according to this embodiment will be described.

Figure 2:
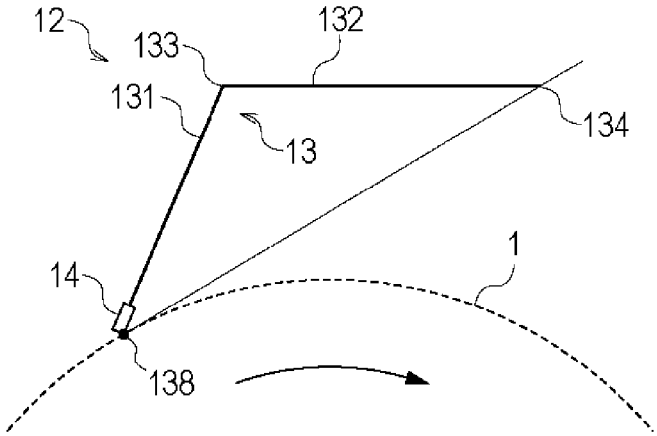
FIG. 2 is a schematic illustration of a cleaning member in Embodiment 1.

FIG. 2 is a schematic illustration of the cleaning member 12 in this embodiment. The cleaning member 12 is fixed at a fixing portion and removes the toner 4, remaining after the transfer, from the photosensitive drum 1 which is a member to be cleaned. The cleaning member 12 is constituted by a blade 14 contacted to the photosensitive drum 1 in a counter direction to a movement direction (the arrow direction in FIG. 2) of the photosensitive drum 1, and a flexibility supporting member 13 for supporting the blade 14.

The supporting member 13 is constituted by one end portion 131 where the blade 14 is provided, another end portion 132 including a portion to be fixed 134 fixed at the fixing portion, and a bent portion 133 located between the one end portion 131 and the another end portion 132. The bent portion 133 is positioned in a side where it is spaced from the surface of the photosensitive drum 1 toward an outside (in a side where the bent portion 133 is moved away from the surface of the photosensitive drum 1) with respect to a line segment L connecting the portion to be fixed 134 and a contact portion 138 where the blade 14 is contacted to the photosensitive drum 1. Further, the portion to be fixed 134 of the supporting member 13 is disposed downstream of the contact portion 138 with respect to the movement direction of the photosensitive drum 1, and the blade 14 is supported by only the one end portion 131.

By constituting the cleaning member 12 as described above, even when a frictional force between the photosensitive drum 1 and the blade 14 is increased, an abrupt increase in a contact pressure of the blade 14 can be suppressed. An action thereof will be described.

First, a cleaning member 212 in Comparative Embodiment will be described. FIGS. 17 and 18 are schematic illustrations of a conventionally known cleaning member as Comparative Embodiment. A urethane rubber blade 214 which is an elastic member is supplied by a supporting member 213 having rigidity, and is contacted to a photosensitive drum 201. Then, the blade 214 having elasticity is pressed against (deformed on) the surface of the photosensitive drum 201 to obtain a contact pressure for removing a residual toner 204 from the surface of the photosensitive drum 201.

When the photosensitive drum 201 is rotated, the blade 214 receives a force of resultant force F3 which is resultant force between reaction F1 by the contact pressure of the blade 214 and frictional force F2 between the surface of the photosensitive drum 201 and the blade 214. When the frictional force F2 is increased, the resultant force F3 becomes large. The blade 214 has a relatively small degree of freedom with respect to a direction of the resultant force F3. Therefore, the blade 214 is deformed with respect to an arrow B direction in FIG. 17. This deformation direction is a direction in which the blade 214 enters the photosensitive drum 201 and therefore the reaction F1 becomes large. When the reaction F1 is increased, the frictional force F2 is further increased. As a result, the resistance F1 is abruptly increased. For this reason, there arose a problem of an increase in driving torque for driving the photosensitive drum 201 and turning-up of the blade 24 in some cases.

Figure 3:
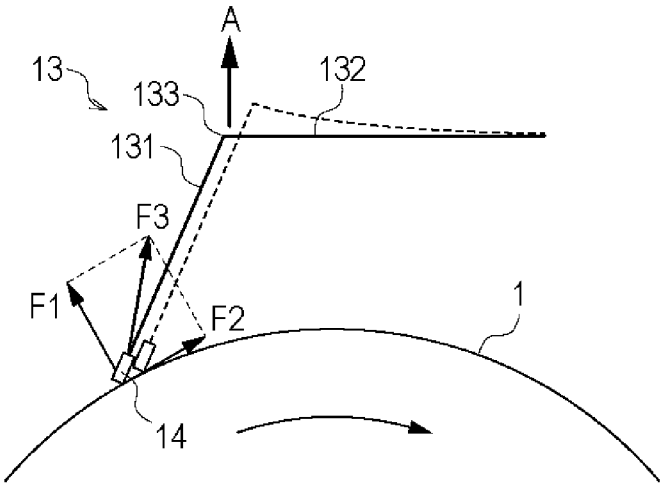
FIG. 3 is a schematic diagram showing a state in which a supporting member is deformed in Embodiment 1.

Next, the cleaning member 12 in this embodiment will be described. FIG. 3 is a schematic diagram showing a state in which the flexibility supporting member 13 is deformed when the frictional force between the surface of the photosensitive drum 1 and the blade 14 is increased.

In the cleaning member 12 in this embodiment of the present invention, the flexibility supporting member 13 is pressed against (deformed on) the surface of the photosensitive drum 1 to obtain a contact pressure for removing the residual toner from the surface of the photosensitive drum 1.

When the photosensitive drum 1 is rotated, the blade 14 receives a force of resultant force F3 which is resultant force between resistance F1 by the contact pressure of the supporting member 13 and frictional force F2 between the surface of the photosensitive drum 1 and the blade 14. With respect to this resultant force F3, the one end portion 131 has a small angle formed between itself and the resultant force F3 and therefore a degree of freedom of deformation is very small, so that the one end portion 131 is not readily deformed (i.e., thrusts). On the other hand, with respect to a direction of the resultant force F3, the other end portion 132 has a large angle formed between itself and the resultant force F3 and therefore the degree of freedom of deformation is high. Therefore, as indicated by a broken line in FIG. 3, the other end portion 132 is deformable. Further, the other end portion 132 can be deformed with respect to an arrow A direction in FIG. 3, so that the blade 14 supported by the supporting member 13 is prevented from entering the photosensitive drum 1. As a result, the increase in reaction F1 is suppressed. For this reason, the increase in driving torque for driving the photosensitive drum 1 and the turning up of the blade 13 can be suppressed.

Incidentally, the other end portion 132 may desirably be constituted to strongly receive bending moment by the resultant force F3. Therefore, the one end portion 131 may desirably be configured so that it receives the force from the blade 14 to elastically deform the other end portion 132.

Further, it is important that the another end portion 132 can be elastically deformed with respect to the arrow A direction in FIG. 3 by the resultant force F3. Therefore, it is desirable that the blade 14 is provided by being supported by only the one end portion 131 so as not to extend to the bent portion 133, thus being prevented from impairing the elastic deformation (bending) of the another end portion 132.

Figure 4:
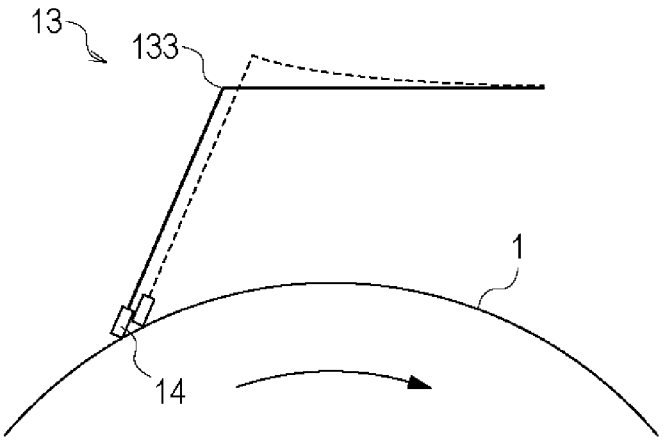
FIG. 4 is a schematic diagram showing the state in which the supporting member is deformed when a photosensitive drum is moved from a rest state.

FIG. 4 is a schematic diagram showing a state in which the supporting member 13 is deformed when the photosensitive drum 1 is moved from a rest state. It is desirable that the blade 14 supported by the supporting member 13 is prevented from further entering the photosensitive drum 1. Therefore, when the photosensitive drum 1 is moved from its rest state, it is desirable that the bent portion 133 is movable in a direction in which the bent portion 133 is moved away from the surface of the photosensitive drum 1.

As a material for the supporting member 13, it is possible to use engineering plastics such as polyacetal (POM), polycarbonate (PC) and polyphenylene sulfide (PPS). The supporting member 13 may only be required to obtain a desired cleaning contact pressure by adjusting its plate thickness, lengths of the one end portion 131 and the another other end portion 132, and a penetration depth (entering amount) of the cleaning member 12 with respect to the photosensitive drum 1.

Further, as a material for the supporting member 13, it is possible to use also a spring member of metal having a spring property, such as SUS or phosphor bronze plate. Compared with the above-described engineering plastics, the metal material is advantageous in terms of productivity, cost, accuracy and the like. Further, a damping member or the like having elasticity can also be used.

Next, the cleaning device 11 will be described. The cleaning device 11 includes a cleaning container as an accommodating portion, constituted by a frame, for accommodating the toner 4 removed from the photosensitive drum 1, a fixing portion 153 provided to the cleaning container 15, and the cleaning member 12.

Figure 1:
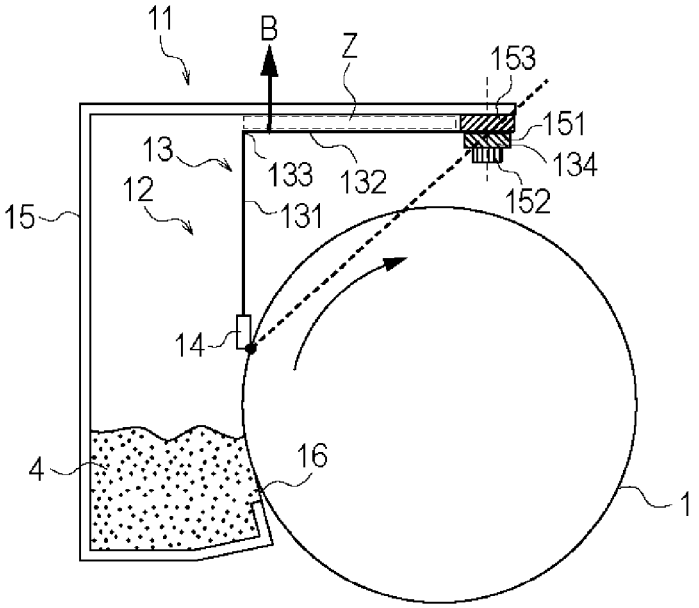
FIG. 1 is a schematic illustration of a cleaning device in Embodiment 1.

FIG. 1 is a schematic illustration of the cleaning device 11 in this embodiment.

The cleaning device 11 is constituted by the cleaning member 12, a scooping sheet 16, and the cleaning container 15. The cleaning member 12 is used for scraping off the residual toner 4 remaining on the photosensitive drum 1 after the transfer while being in contact to the surface of the photosensitive drum 1. The scooping sheet 16 is provided, upstream of the cleaning member with respect to the movement direction of the photosensitive drum 1, for scooping the scraped toner 4, and is contacted to the surface of the photosensitive drum 1. The cleaning container 15 stores the scooped residual toner 4. The cleaning member 12 is fixed, on the fixing portion 153 provided to the cleaning container 15, at the portion to be fixed 134 of the supporting member 13. As an example of a fixing method of fixing the cleaning member to the cleaning container 15, as shown in FIG. 1, the cleaning member 12 is fixed via a holding member 151 via mounting screws 152 provided at several positions with respect to a longitudinal direction.

A region ranging from a bent portion 133 to a portion to be fixed 134 is provided opposed to an inner wall of the cleaning container 15. The flexibility supporting member 13 is elastically deformed in the region ranging from the bent portion 133 to the portion to be fixed 134 with respect to the arrow B direction in FIG. 1 when the photosensitive drum 1 is mounted and when the photosensitive drum 1 is rotated. Particularly, the supporting member 13 is largely deformed in the neighborhood of the bent portion 133. At this time, when the region ranging from the bent portion 133 to the portion to be fixed 134 interferes with the inner wall of the cleaning container 15, an effect of the present invention cannot be obtained. Therefore, between the region ranging from the bent portion 133 to the portion to be fixed 134 and the inner wall of the cleaning container 15, a gap Z is provided. The gap Z is, in order to permit elastic deformation of the region ranging from the bent portion 133 to the portion to be fixed 134, set at a distance corresponding to a deformation amount or more. In this embodiment, the gap Z is set at 3 mm.

Next, the process cartridge 17, detachably mountable to the main assembly M of the image forming apparatus, including the photosensitive drum 1, the fixing portion 153 provided to the cleaning container 15 and the cleaning member 12 according to the present invention will be described.

Figure 5:
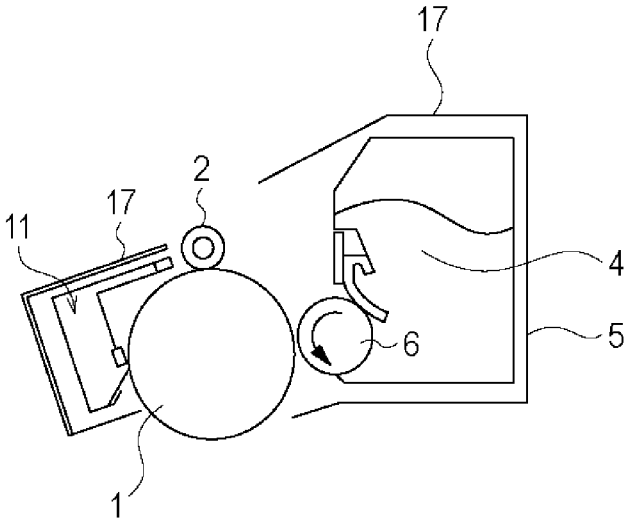
FIG. 5 is a schematic illustration of a process cartridge in Embodiment 1.

FIG. 5 is a schematic illustration of the process cartridge 17 in this embodiment. The process cartridge 17 is prepared by integrally assembling four process devices, of the photosensitive drum 1, the charging roller 2, the developing device 5 and the cleaning device 11, with a cartridge container. Further, the process cartridge 17 is constituted so as to be detachably mountable to the image forming apparatus main assembly M.

The cleaning member 12 will be described more specifically.

Figure 6:
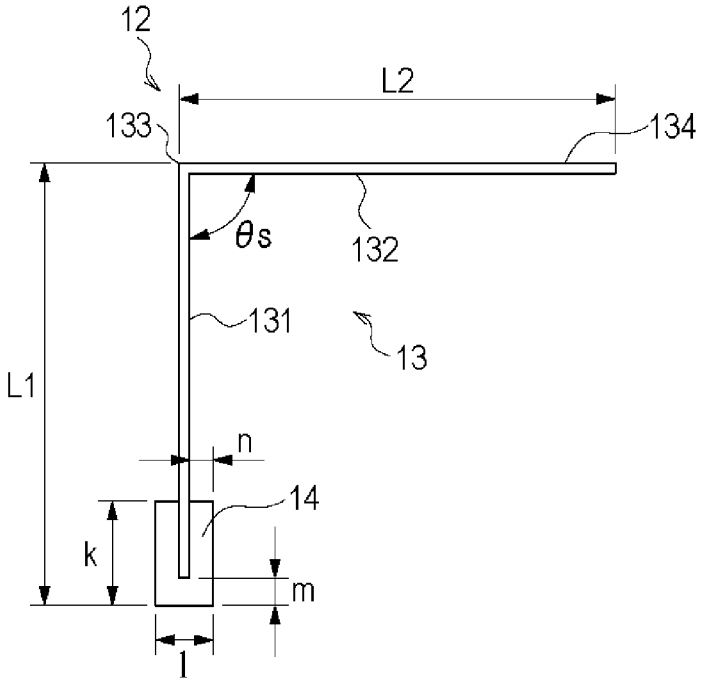
FIG. 6 is a detailed structural view of the cleaning member in Embodiment 1.

FIG. 6 is a detailed structural view of the cleaning member in this embodiment.

As described above, the cleaning member 12 is constituted by the flexibility supporting member 13 and the blade 14. The supporting member 13 is constituted by the one end portion 131 where the blade 14 is provided, the another end portion 132 including the portion to be fixed 134 fixed at the fixing portion 153 of the cleaning container 15, and the bent portion 133 located between the one end portion 131 and the another end portion 132. Further, the bent portion 133 is positioned in a side where it is spaced from the surface of the photosensitive drum 1 toward an outside with respect to a line segment connecting the portion to be fixed 134 and a contact portion 138 where the blade 14 is contacted to the photosensitive drum 1.

In this embodiment, as the material for the supporting member 13, SUS material was used. The plate thickness t of the supporting member 13 was 0.2 mm. An angle θ of the bent portion 133 shown in FIG. 6 was 90 degrees uniformly with respect to a rotational axis direction of the photosensitive drum 1. In this case, when a length of the one end portion 131 of the supporting member 13 is L1 and a length of the other end portion 132 is L2, L1 was 12 mm and L2 was 12 mm. Further, similarly as in the conventional cleaning member, a set angle between the photosensitive drum 1 and the cleaning member 12 was 30 degrees and the penetration depth was 1.05 mm.

In this case, the contact pressure of the cleaning member 12 to the photosensitive drum 1 was about 35 gf per cm with respect to the rotational axis direction of the photosensitive drum 1. For comparison, when checking was made at the set angle of 20 degrees, the contact pressure was about 30 gf per cm with respect to the rotational axis direction of the photosensitive drum 1.

Incidentally, the angle θs of the bent portion 133 is not particularly required to be 90 degrees. The angle θ may only be required to provide a predetermined contact pressure by adjusting the length L1 of the one end portion 131, the length L2 of the another end portion 132, the set angle and the penetration depth.

As the material for the blade member 14, the urethane rubber was used. The blade 14 had JIS A hardness of 70 degrees. It is desirable that a degree of deformation of the blade member 14 itself is decreased and a force of the one end portion 131 for elastically deforming the other end portion 132 is increased. Therefore, the shape of the blade member 14 may preferably be, as shown in FIG. 6, such that the influence on the deformation by the deformation is minimized, and in this embodiment, k=3.0 mm, l=2.0 mm, m=0.5 mm and n=0.5 mm were set.

As Comparative Embodiment 1, also the conventionally known cleaning member 212 was checked. FIG. 17 is a detailed structural view of the conventionally known cleaning member 212. The blade 214 is supported at an end portion of the supporting member 213 having rigidity. By the deformation of the blade 214 which is an elastic member, the cleaning contact pressure is obtained. As the material for the blade 214, the urethane rubber was used, and hardness of the blade 214 was 70 degrees in terms of JIS-A hardness. A length of a free end of the blade 214 shown in FIG. 17 was taken as L, and L was 5.2 mm. As the material for the supporting member 213, SUS material was used. The plate thickness thereof was set at 1.8 mm. The set angle between the photosensitive drum 201 and the cleaning member 212 was 30 degrees and the penetration depth was 1.05 mm. In this case, the contact pressure of the cleaning member 212 to the photosensitive drum 201 was about 35 gf per cm.

These contact pressures were subjected to deformation calculation, dynamic contact pressure was calculated. As a calculating method, applied friction was assumed and a relationship between a deformation shape and an applied force when the end portion of the cleaning member entered the photosensitive drum in one full circumference with respect to the downstream direction was calculated. Further, from the obtained forces, a component perpendicular to the surface of the photosensitive drum was taken as the contact pressure, and a component parallel to the surface of the photosensitive drum was taken as a frictional force. Further, a ratio between the contact pressure and the frictional force was obtained as a friction coefficient.

As the deformation calculation in this case, in consideration of neutral axes of the blade supporting member and the blade, a simple two-dimensional cantilever beam (assumption of Bernoulli-Euler) was used as a model and was subjected to the calculation. Incidentally, as parameters for the calculation, a longitudinal bending modulus E of the SUS plate of 167,000 MPa and a longitudinal modulus E of the urethane rubber of 6 MPa were used.

Parts (a) and (b) of FIG. 7 show the results. In these figures, the abscissa represents a coefficient of dynamic friction and the ordinate represents the contact pressure. Part (a) of FIG. 7 shows the result of Embodiment 1, and (b) of FIG. 7 shows the result of Comparative Embodiment 1. It can be understood that a change in contact pressure with respect to the coefficient of dynamic friction is very small in Embodiment 1 compared with Comparative Embodiment 1.

Parts (a) and (b) of FIG. 8 show a relationship between the coefficient of dynamic friction and the frictional force. In these figures, the abscissa represents the coefficient of dynamic friction, and the ordinate represents the frictional force. Part (a) of FIG. 8 shows the result of Embodiment 1, and (b) of FIG. 8 shows the result of Comparative Embodiment 1. It can be understood that a change in frictional force with respect to the coefficient of dynamic friction is small in Embodiment 1 compared with Comparative Embodiment 1. In Comparative Embodiment 1, the frictional force is accelerateadly increased with the increase in coefficient of dynamic friction. On the other hand, in Embodiment 1, the frictional force is retained as a substantially linear increase with the increase in coefficient of dynamic friction. Also in the above-described modeling calculation, by employing the constitution of the cleaning member 12 in this embodiment, it was confirmed that stabilization of the contact pressure was able to be realized compared with the case of the conventional cleaning member.

Embodiment 2

Next, assuming that the cleaning device 11 is demounted by a user from the image forming apparatus main assembly for clearing paper jam or the like and thus the toner 4 accommodated in the cleaning container 15 is localized, the following demounting and mounting operation was performed. The toner 4 in some amount was accommodated in the cleaning container 15 and thereafter the cleaning device 11 was demounted from the image forming apparatus main assembly M and then as shown in FIG. 9, the cleaning device 11 was directed downward along an arrow C direction, so that the toner 4 in the cleaning container 15 was localized in a lower side. Thereafter, the cleaning device 11 was mounted in the image forming apparatus main assembly M.

Case of Comparative Embodiment 2

Comparative Embodiment 2 will be described with reference to FIG. 19.

A schematic illustration of a cleaning device 311 used as Comparative Embodiment 2 is shown in FIG. 19. When the cleaning device 311 is mounted in the image forming apparatus main assembly M, the cleaning device 311 is disposed so that a portion to be fixed 334 of a supporting member 313 is located at a lower position than a bent portion 333. A condition, such as the blade contact pressure, for a cleaning member 312 is the same as that in Embodiment 1.

As shown in FIG. 19, a toner 304 is localized and thereafter the cleaning device 311 is mounted in the image forming apparatus main assembly M. At that time, the toner 304 is deposited as it is in a gap Z3 between an inner wall of a cleaning container 315 and a region, of the supporting member 313, ranging from the bent portion 333 to the portion to be fixed 334, so that the toner 304 in the gap Z3 is in a packing state in some cases.

As a result, when a frictional force between the surface of the photosensitive drum 1 and a blade portion 314 is increased, the elastic deformation of the supporting member 313 in an arrow G direction is impaired.

In Comparative Embodiment 2, in consideration of the pressure applied from the toner 304 onto the supporting member 313, the contact pressure at the time when a friction coefficient with the photosensitive drum 301 was increased was estimated.

A result in Comparative Embodiment 2 is shown in (b) of FIG. 10, in which the abscissa represents the coefficient of dynamic friction, and the ordinate represents the contact pressure. It is understood that a change in contact pressure with respect to the coefficient of dynamic friction is large.

In the constitution in Comparative Embodiment 2, when the cleaning device 311 is demounted and mounted in a state in which the toner 304 remains in the cleaning container 315 to some extent, the contact pressure is abruptly increased at the time when the frictional force between the surface of the photosensitive drum 301 and the blade portion 314 increases.

Case of Embodiment 2

Embodiment 2 will be described with reference to FIG. 11.

A schematic illustration of a cleaning device 11 used as Embodiment 2 is shown in FIG. 11. As shown in FIG. 11, Embodiment 2 is characterized in that when the cleaning device 11 is mounted in the image forming apparatus main assembly M, the cleaning device 11 is disposed so that a portion to be fixed 134 of a supporting member 13 is located at a higher position than, i.e., above a bent portion 133.

As shown in FIG. 9, the toner 4 is localized and thereafter the cleaning device 11 is mounted in the image forming apparatus main assembly M. At that time, most of the toner 4 is dropped, by its own weight, from the gap Z between an inner wall of a cleaning container 315 and a region, of the supporting member 313, ranging from the bent portion 333 to the portion to be fixed 334. Therefore, the toner 4 in the gap Z is not in a packing state. Therefore, such a force for preventing the supporting member 13 from being elastically deformed in the arrow D direction is little applied to the supporting member 13. Thus, the supporting member 13 is elastically deformed in the arrow D direction, the blade portion 14 is movable so as to be spaced from the photosensitive drum 1. As a result, as shown in (a) of FIG. 10, even when the toner 4 is accommodated in the cleaning container 15, similarly as in the case where the toner 4 is not accommodated, the increase in contact pressure can be suppressed at the time when the frictional force between the surface of the photosensitive drum 1 and the blade portion 14 increases.

As described above, in this embodiment, when the cleaning device 11 is demounted from the apparatus main assembly M, the residual toner can enter the gap Z between the cleaning container 15 and the another end portion 132 of the supporting member 13. However, by mounting the above-constituted cleaning device 11 in the apparatus main assembly M, the residual toner is dropped from the gap Z. Therefore, the another end portion 132 is not prevented from being elastically deformed, so that the contact pressure at which the blade portion 14 is contacted to the surface of the photosensitive drum 1 can be stabilized.

Embodiment 3

Embodiment 3 will be described with reference to FIG. 12.

A schematic illustration of a cleaning device 11 used as Embodiment 3 is shown in FIG. 12.

The cleaning device 11 is mounted in the image forming apparatus main assembly M. At that time, the cleaning member 11 is characterized by being disposed so that an angle θ formed between another end portion 132 and a horizontal line passing through a bent portion 133 of a supporting member 13 is equal to or more than an angle of repose of the toner 4 accommodated in the cleaning container 15.

Here, the angle of repose refers to an angle of an inclined surface of the toner with respect to a horizontal plate when the toner heaped up on the horizontal plate naturally slips down the inclined surface.

The angle of repose of the toner 4 accommodated in the cleaning container 15 used in this embodiment is 60 degrees. In this embodiment, when the cleaning device 11 is mounted in the image forming apparatus main assembly M, the angle θ formed between the another end portion 132 and the horizontal line passing through the bent portion 133 of the supporting member 13 was set at 65 degrees.

Similarly as in Embodiment 2, the toner 4 was accommodated in the cleaning container 15 to some extent and thereafter the cleaning device 11 was demounted from the image forming apparatus main assembly M, so that the toner 4 was localized as shown in FIG. 9.

Even after the toner 4 is localized, the angle θ of the another end portion 132 with respect to the horizontal direction is not less than the angle of repose of the toner 4 accommodated in the cleaning container 15 and therefore the toner 4 is completely dropped from the portion of the gap Z. Therefore, the toner 4 in the gap Z is not in a packing state. Therefore, such a force for preventing the supporting member 13 from being elastically deformed in the arrow E direction is not applied to the supporting member 13. Thus, the supporting member 13 is elastically deformed in the arrow E direction, the blade portion 14 is movable so as to be spaced from the photosensitive drum 1. As a result, even when the toner 4 is accommodated in the cleaning container 15, similarly as in the case where the toner 4 is not accommodated, the increase in contact pressure can be suppressed at the time when the frictional force between the surface of the photosensitive drum 1 and the blade portion 14.

As described above, in this embodiment, when the cleaning device 11 is demounted from the apparatus main assembly M, the residual toner can enter the gap Z between the cleaning container 15 and the another end portion 132 of the supporting member 13. However, by mounting the above-constituted cleaning device 11 in the apparatus main assembly M, the residual toner is dropped from the gap Z. Therefore, the another end portion 132 is not prevented from being elastically deformed, so that the contact pressure at which the blade portion 14 is contacted to the surface of the photosensitive drum 1 can be stabilized.

Embodiment 4

A cleaning device 11 in Embodiment 4 will be described.

A schematic illustration of the cleaning device 11 used as Embodiment 4 is shown in FIG. 13.

The cleaning device 11 is constituted by a cleaning member 12, a scooping sheet 16, and a cleaning container 15. The cleaning member 12 is used for scraping off the toner 4 remaining on the photosensitive drum 1 after the transfer while being in contact to the surface of the photosensitive drum 1. The scooping sheet 16 is provided, upstream of the cleaning member with respect to the movement direction of the photosensitive drum 1, for scooping the scraped toner 4, and is contacted to the surface of the photosensitive drum 1. The cleaning container 15 stores the scooped toner 4. The supporting member 13 supports the blade 14 and is characterized by being a flexibility curve-shaped supporting member 13. The supporting member 13 is constituted by a blade portion supporting portion 135 where the blade 14 is provided in its end side, a portion to be fixed 134 fixed at the fixing portion 153, and a bent top 137 located between the blade portion supporting portion 135 and the portion to be fixed 134. Further, the bent top 137 is positioned in a side where it is spaced from the surface of the photosensitive drum 1 toward an outside with respect to a line segment connecting the portion to be fixed 134 and a contact portion 138 where the blade portion 14 is contacted to the photosensitive drum 1.

Further, the portion to be fixed 134 of the supporting member 13 is disposed downstream of the contact pressure 138 with respect to the movement direction of the photosensitive drum 1.

A region, of the flexibility curve-shaped supporting member 13, ranging from the bent top 137 to the portion to be fixed 134 is disposed opposite to the inner wall of the cleaning container 15. As described above, the supporting member 13 is largely deformed when the photosensitive drum 1 is mounted and when the photosensitive drum 1 is rotated. In this case, when the region from the bent top 137 to the portion to be fixed 134 interferes with the inner wall of the cleaning container 15, an effect of the present invention cannot be obtained. Therefore, as shown in FIG. 13, the gap Z is provided between the inner wall of the cleaning container 15 and the region from the bent top 137 to the portion to be fixed 134. As the gap Z, a distance corresponding to a deformation amount or more is set in order to permit elastic deformation of the region from the bent top 137 to the portion to be fixed 134. In this embodiment, the gap Z is configured to provide a distance of 3 mm at the closest position.

By employing the constitution in Embodiment 4, the cleaning device 11 can be downsized and particularly can be made thin. Further, an accommodation volume for accommodating the residual toner 4 can be increased.

Further, as shown in FIG. 13, the cleaning device 11 is mounted in the image forming apparatus main assembly M, the cleaning device 11 is disposed so that a portion to be fixed 134 of a supporting member 13 is located at a higher position than, i.e., above the bent top 137. Even after the toner 4 is localized, when the cleaning device 11 is mounted in the image forming apparatus main assembly M, most of the toner 4 is dropped, by its own weight, from the gap Z between the inner wall of the cleaning container 15 and the region, of the supporting member 13, ranging from the bent top 137 to the portion to be fixed 334. Therefore, the toner 4 in the gap Z is not in a packing state. Therefore, even when the toner 4 is accommodated in the cleaning container 15, substantially similarly as in the case where the toner 4 is not accommodated, the increase in contact pressure can be suppressed at the time when the frictional force between the surface of the photosensitive drum 1 and the blade portion 14.

Further, when the cleaning device 11 is mounted in the image forming apparatus main assembly M, the angle formed between the horizontal line passing through the bent top 137 of the supporting member 13 and the region from the bent top 137 to the portion to be fixed 134 is equal to or more than the angle of repose of the toner 4. In this embodiment, the angle between the horizontal line and the region is set at 60 degrees at the minimum. Even after the toner 4 is localized, when the cleaning device 11 is mounted in the apparatus main assembly M, the angle between the horizontal line and the region is not less than the angle of repose of the toner 4 accommodated in the cleaning container 15. Therefore, the toner 4 is completely dropped from the portion of the gap Z. Therefore, even when the toner 4 is accommodated in the cleaning container 15, similarly as when the toner 4 is not accommodated, the increase in contact pressure can be suppressed even at the time when the frictional force between the surface of the photosensitive drum 1 and the blade portion 14 is increased.

As described above, in this embodiment, when the cleaning device 11 is demounted from the apparatus main assembly M, the residual toner can enter the gap Z between the cleaning container 15 and the region, of the supporting member 13, from the bent top 137 to the portion to be fixed 134. However, by mounting the above-constituted cleaning device 11 in the apparatus main assembly M, the residual toner is dropped from the gap Z. Therefore, the another end portion 132 is not prevented from being elastically deformed, so that the contact pressure at which the blade portion 14 is contacted to the surface of the photosensitive drum 1 can be stabilized.

INDUSTRIAL APPLICABILITY

As described above, by employing the constitution of the present invention, when the image bearing member is driven, the contact pressure can be stabilized more than that in the conventional cleaning member. That is, it becomes possible to suppress the increase in torque and the turning-up of the blade when the image bearing member is driven.

Further, even in the case where the residual toner removed from the photosensitive drum is localized in the gap portion between the cleaning container and the cleaning member by the demounting and mounting of the cleaning device, during the mounting of the cleaning device in the image forming apparatus main assembly, the residual toner does not remain in the gap. As a result, motion of the cleaning member is not impaired, so that the contact pressure can be stabilized more than that in the conventional cleaning member.

While the invention has been described with reference to the structures disclosed herein, it is not confined to the details set forth and this application is intended to cover such modifications or changes as may come within the purpose of the improvements or the scope of the following claims.

The invention claimed is:

1. A cleaning device for use with an image forming apparatus, comprising:

a fixing portion provided on a frame;

a cleaning member, to be fixed at said fixing portion, for removing a developer from an image bearing member, wherein said cleaning member includes:

a blade portion contacted to the image bearing member with respect to a counter direction that is counter to a movement direction of the image bearing member; and a flexible supporting member for supporting said blade portion, said supporting member including one end portion where said blade portion is provided, another end portion including a portion to be fixed for being fixed at said fixing portion, and a bent portion between said one end portion and said other end portion in a side remote from a surface of the image bearing member toward an outside with respect to a line connecting said portion to be fixed and a contact portion where said blade portion is contacted to the image bearing member, wherein said portion to be fixed is provided downstream of said contact portion with respect to the movement direction of the image bearing member; and an accommodating portion, defined by the frame, for accommodating the developer removed from the image bearing member, wherein between the frame and said other end portion, a gap for permitting elastic deformation of said other end portion is provided, and wherein said bent portion is positioned downstream of said one end portion and upstream of said other end portion with respect to the movement direction of the image bearing member.

2. A cleaning device according to claim 1, wherein in a state in which said cleaning device is mounted in a main assembly of the image forming apparatus, a position of said portion to be fixed is above a position of said bent portion.

3. A cleaning device according to claim 1, wherein in a state in which said cleaning device is mounted in a main assembly of the image forming apparatus, a position of said portion to be fixed is above or at the same level as a position of said bent portion, and an angle formed between a horizontal line passing through said bent portion and a line connecting said bent portion and said portion to be fixed is not less than an angle of repose of the developer.

4. An image forming apparatus for forming an image on a recording material, comprising:

at least an image bearing member; and a cleaning device according to claim 1.

5. A process cartridge detachably mountable to an image forming apparatus, comprising:

at least an image bearing member; and a cleaning device according to claim 1.

6. A cleaning device for use with an image forming apparatus, comprising:

a fixing portion provided on a frame;

a cleaning member, to be fixed at said fixing portion, for removing a developer from an image bearing member, wherein said cleaning member includes:

a blade portion contacted to the image bearing member with respect to a counter direction that is counter to a movement direction of the image bearing member; and a flexible curve-shaped supporting member for supporting said blade portion, said supporting member including a blade portion supporting portion where said blade portion is provided in its end side, a portion to be fixed for being fixed at said fixing portion, and a bent top between said blade portion supporting portion and said portion to be fixed in a side remote from a surface of the image bearing member toward an outside with respect to a line connecting said portion to be fixed and a contact portion where said blade portion is contacted to the image bearing member, wherein said portion to be fixed is provided downstream of said contact portion with respect to the movement direction of the image bearing member; and an accommodating portion, defined by the frame, for accommodating the developer removed from the image bearing member, wherein between the frame and a region ranging from said bent top to said portion to be fixed, a gap for permitting elastic deformation of said region is provided.

7. A cleaning device according to claim 6, wherein in a state in which said cleaning device is mounted in a main assembly of the image forming apparatus, a position of said portion to be fixed is above a position of said bent top.

8. A cleaning device according to claim 6, wherein in a state in which said cleaning device is mounted in a main assembly of the image forming apparatus, a position of said portion to be fixed is above or at the same level as a position of said bent top, and an angle formed between a horizontal line passing through said bent top and a line connecting said bent top and said portion to be fixed is not less than an angle of repose of the developer.

9. An image forming apparatus for forming an image on a recording material, comprising:

at least an image bearing member; and a cleaning device according to claim 6.

10. A process cartridge detachably mountable to an image forming apparatus, comprising:

at least an image bearing member; and a cleaning device according to claim 6.

11. A cleaning device for use with an image forming apparatus, comprising:

a fixing portion provided on a frame;

a cleaning member, to be fixed at said fixing portion, for removing a developer from an image bearing member, wherein said cleaning member includes:

a blade portion contacted to the image bearing member; and a flexible supporting member for supporting said blade portion, said supporting member including one end portion where said blade portion is, another end portion including a portion to be fixed for being fixed at the fixing portion, and a bent portion between said one end portion and said other end portion, and an accommodating portion, defined by the frame, for accommodating the developer removed from the image bearing member, wherein the bent portion is positioned downstream of said one end portion and upstream of said other end portion with respect to a movement direction of the image bearing member.

12. A cleaning device for use with an image forming apparatus, comprising:

a fixing portion provided on a frame;

a cleaning member, to be fixed at said fixing portion, for removing a developer from an image bearing member, wherein said cleaning member includes:

a blade portion contacted to the image bearing member with respect to a counter direction that is counter to a movement direction of the image bearing member; and a flexible supporting member for supporting said blade portion, said supporting member including one end portion where said blade portion is provided, another end portion including a portion to be fixed for being fixed at the fixing portion, and a bent portion between said one end portion and said other end portion in a side opposite to a side including a rotational center of the image bearing member with respect to a line connecting said portion to be fixed and a contact portion where said blade portion is contacted to the image bearing member, wherein said portion to be fixed is provided downstream of said contact portion with respect to the movement direction of the image bearing member; and an accommodating portion, defined by the frame, for accommodating the developer removed from the image bearing member, wherein between the frame and said other end portion, a gap for permitting elastic deformation of said other end portion is provided.

13. A cleaning device according to claim 12, wherein the bent portion is positioned downstream of said one end portion and upstream of said other end portion with respect to the movement direction of the image bearing member.

* * * * *